US005430460A

United States Patent [19]

Takabatake et al.

[11] Patent Number: 5,430,460

[45] Date of Patent: Jul. 4, 1995

[54] METHOD AND APPARATUS FOR DRIVING LIQUID CRYSTAL DISPLAY UNIT

[75] Inventors: Masaru Takabatake; Masuyuki Ohta; Tohru Sasaki, all of Mobara; Makoto Tsumura, Hitachi, all of Japan

[73] Assignee: Hitachi, Ltd., Tokyo, Japan

[21] Appl. No.: 328,547

[22] Filed: Oct. 25, 1994

Related U.S. Application Data

[63] Continuation of Ser. No. 945,935, Sep. 17, 1992, abandoned.

[30] Foreign Application Priority Data

Sep. 17, 1991 [JP] Japan ..... 3-235928

[51] Int. Cl.[6] ..... G09G 3/36

[52] U.S. Cl. ..... 345/96; 345/209

[58] Field of Search ..... 345/87, 89, 90, 94, 345/95, 96, 208, 209, 210, 790, 792, 793; 359/54, 58

[56] References Cited

U.S. PATENT DOCUMENTS

| | | | |
|---|---|---|---|
| 4,591,848 | 5/1986 | Morozumi et al. | 340/784 |
| 4,734,692 | 3/1988 | Hosono et al. | 345/96 |
| 4,870,399 | 9/1989 | Carlson | 340/784 |
| 4,922,240 | 5/1990 | Duwaer | 340/784 |

*Primary Examiner*—Alvin E. Oberley
*Assistant Examiner*—Regina Liang
*Attorney, Agent, or Firm*—Antonelli, Terry, Stout & Kraus

[57] ABSTRACT

A method for driving a liquid crystal display unit is arranged to apply positive-polarity signals to drains of thin film transistors of active matrix liquid crystal elements during an interval of a 1/n field and to apply negative-polarity signals to the drains during an interval of a next 1/n field. This method does not need to invert a common electrode voltage $V_{com}$ and a signal voltage $V_D$ at each scan period (1H). This contributes to easier design of a voltage-alternating circuit for $V_D$ or $V_{com}$ and reduces flicker resulting from the inversed voltage on an overall screen.

18 Claims, 9 Drawing Sheets

METHOD AND APPARATUS FOR DRIVING LIQUID CRYSTAL DISPLAY UNIT

This application is a continuation of application Ser. No. 945,935, filed on Sep. 17, 1992 now abandoned.

BACKGROUND OF THE INVENTION

The present invention relates to a liquid crystal display unit, and more particularly to a method for driving such a display which contributes significantly to improving the reliability of an active matrix liquid crystal display.

The conventional methods for driving an active matrix liquid crystal display have been disclosed in U.S. Pat. Nos. 4,906,984 (Takeda), 4,186,395 (Fujita), 4,870398 (Bos), 5,010,327 (Wakita), 5,010,328 (Morris), and JP-A-No. 62-54230. For example, the prior art disclosed in JP-A-No. 62-54230 is designed to invert a polarity of a scan voltage to be applied into each scan line for the purpose of reducing flicker and an amplitude of a signal voltage.

As is well known, frame is the time period of applying a signal of one complete picture, and consists of two fields in interlaced scanning for display.

As one prior art as shown in FIGS. 10*a* and 10*b*, the prior art is designed to have each scan line composed of a liquid crystal pixel capacitance $C_{LC}$ and a connection circuit made of a thin film transistor and a signal line so that a scan voltage $V_G$ is applied to the scan line, a signal voltage $V_D$ is applied to the signal line, and a common voltage $V_{com}$ is applied to an electrode located as opposed to the liquid crystal capacitance $C_{LC}$. The scan voltage $V_G$ is arranged to alternately change the polarity, positive or negative at each scan line (1H).

The above-mentioned driving method is required to invert the signal voltage and the common voltage at each scan line like alternate current. This requirement makes it difficult to design voltage-alternating circuits for both of the signal voltage and the common voltage. As an example, consider an active matrix liquid crystal display having a diagonal of 14 inches and pixels of $1120\times1024$. It needs a time of about 16 $\mu$s for scanning one line and a load capacitance of about 0.3 $\mu$F as viewed from an opposite electrode. This means that the voltage-alternating circuit for the common voltage needs to have quite a low output impedance. It is, therefore, quite difficult to design the voltage-alternating circuit for the common voltage.

SUMMARY OF THE INVENTION

It is an object of the present invention to provide a highly reliable active matrix liquid crystal display which is arranged to solve the above-mentioned problems concerning flicker and signal voltages.

It is a further object of the present invention to provide a less costly and highly reliable active matrix liquid crystal display which does not need to invert a signal voltage $V_D$ and a common voltage $V_{com}$ at each scan line (1H) like alternate current in the method for driving an active matrix liquid crystal display.

It is a still further object of the present invention to provide a method and an apparatus for driving an active matrix liquid crystal display which provide a voltage-alternating circuit for a signal voltage $V_D$ and a voltage-alternating circuit for a common voltage $V_{com}$ to be easily designed and offer high reliability to the active matrix liquid crystal display.

It is another object of the present invention to implement a liquid crystal display and its driving method and apparatus which are more likely to offset the flicker appearing in a group of pixels connected to a group of even scan lines against the flicker appearing in a group of pixels connected to a group of odd scan lines.

In order to solve the foregoing problems, according to an aspect of the invention, a method is provided for driving a liquid crystal display arranged to have thin film transistors provided for driving corresponding pixels located on one substrate in a matrix manner, a plurality of scan electrodes being commonly connected to gates of the thin film transistors in each row, a plurality of signal electrodes being commonly connected to drains of the thin film transistors of each column, one liquid crystal terminal electrode connected to sources of the thin film transistors, and the other electrodes provided on the other substrate opposed to the one substrate for driving the liquid crystal. In particular, this method takes the steps of applying positive-polarity signals into the signal electrodes during a predetermined interval of one field and applying negative-polarity signals into the signal electrodes during the remaining interval of one field.

In a case that the above-mentioned CRT applies to the system of the present invention in place of the liquid crystal display, an experiment has reported that a human may feel a polarity-inverting period as flicker. Hence, it is assured by the experiment that the system of this invention is impractical to the CRT.

In this driving method, during a time interval of one field, positive-polarity signals are applied to a group of pixels connected to a group of odd scan lines and then negative-polarity signals are applied to a group of pixels connected to a group of even scan lines. During the next field, negative-polarity signals are applied to a group of pixels connected to odd scan lines and then positive-polarity signals are applied to a group of pixels connected to even scan lines. This process is repeated. That is, this driving method just needs to invert the signal voltage and the common voltage like alternate current at each field. Further, this method makes it easier to design both of the voltage-alternating circuits for the signal voltage and the common voltages, thereby improving the reliability of an active matrix liquid crystal display. Moreover, in the driving method, it is more likely that the flicker appearing in the group of pixels connected to the even scan lines may be offset against the flicker appearing in the group of pixels connected to the odd scan lines. In addition, the driving method is arranged to invert the signals at a frequency which is double that used in the conventional field inverting method for the CRT. This results in making the frequency of the present method higher than the normal flicker frequency, thereby suppressing the flicker on the overall display screen.

DESCRIPTION OF PREFERRED EMBODIMENTS

Figure 1A:
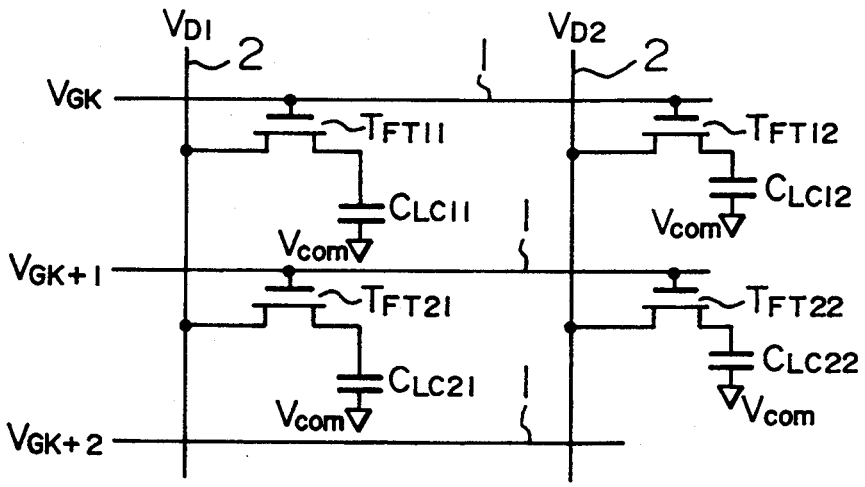
FIGS. 1A and 1B are diagrams showing a driving method according to a first embodiment of the present invention.

At first, an embodiment of this invention will be described as referring to the drawings.

Figure 1B:
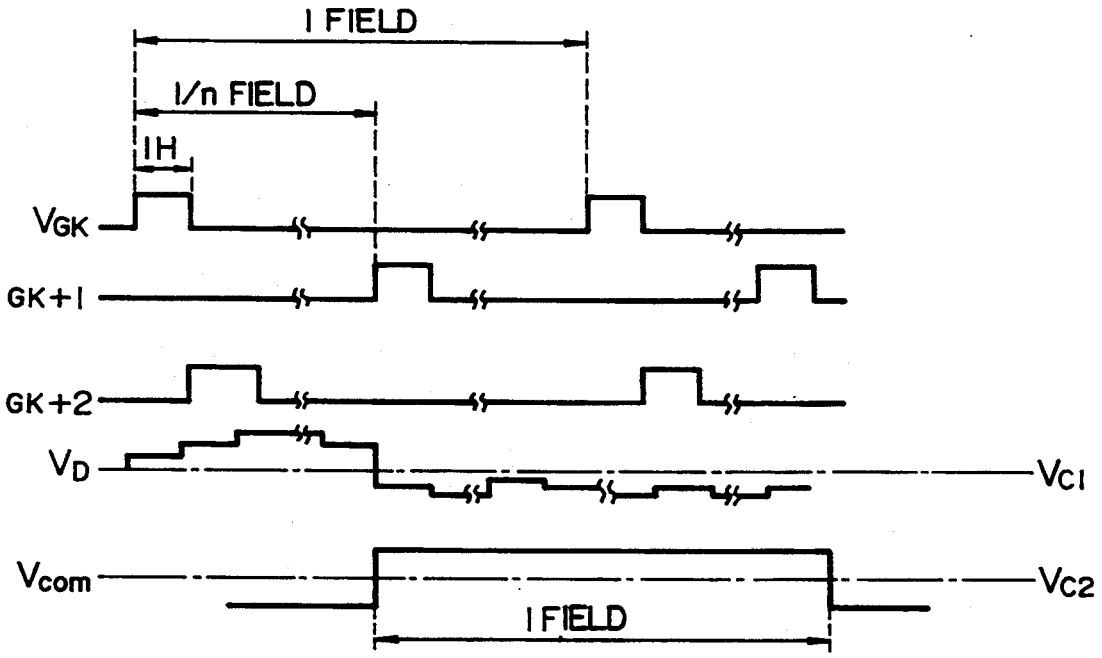

FIGS. 1A and 1B show a driving method according to a first embodiment of the invention. As shown in FIG. 1A, a numeral 1 denotes a scan electrode which is connected to a gate of a thin film transistor (referred to as TFT) 11 to 22. A numeral 2 denotes a signal electrode which is connected to a drain of the TFT. The source of the TFT is connected to one liquid crystal terminal and each opposite electrode is connected to the other liquid crystal terminal. $V_{GK}$, $V_{GK+1}$ and $V_{GK+2}$ denote any gate voltage. $V_D$ denotes any drain voltage. $V_{com}$ denotes a voltage applied to the opposite electrode. $C_{LC11}$, $C_{LC12}$ and $C_{LC21}$ denote a liquid crystal capacitance (pixel). $V_{C1}$ denotes a central voltage of an amplitude of $V_D$. $V_{C2}$ denotes a central voltage of an amplitude of $V_{com}$. 1H denotes a selecting time (scan time) of one scan line. In operation, during a time interval of the first 1/n field, positive-polarity signals $V_D$ are applied to the pixels $C_{LC11}$ and $C_{LC12}$ connected to a group of odd scan lines $V_{GK}$ and $V_{KG+2}$. Then, negative-polarity signals $V_D$ are applied to the pixels $C_{LC21}$ and $C_{LC22}$ connected to a group of even scan lines $V_{GK+1}$. During the next 1/n field, conversely, negative-polarity signals $V_D$ are applied to the pixels $C_{LC11}$ and $C_{LC12}$ connected to the odd scan lines $V_{GK}$ and $V_{KG+2}$. Then, positive-polarity signals are applied to the pixels $C_{LC21}$ and $C_{LC22}$ connected to the even scan lines $V_{GK+1}$. Later, this process is repeated. That is, positive-polarity signals and negative-polarity signals which are shown in one wave-form are switched with switches in a horizontal driver circuit and applied to a group of drain electrodes in such a manner that these positive- and negative-polarity signals are shifted by 1/n (n is an integer larger than one) field. This driving method is, therefore, arranged so as to invert $V_D$ and $V_{com}$ like alternate current at each field. This makes it possible to more easily design both of the voltage-alternating circuits for $V_D$ and $V_{com}$, thereby improving the reliability of an active matrix liquid crystal display to which the driving method applies. Moreover, in the driving method, it is more likely that the flicker appearing in the group of pixels connected to the even scan lines may be offset against the flicker appearing in the group of pixels connected to the odd scan lines. This results in suppressing the flicker on the overall display.

Figure 2A:
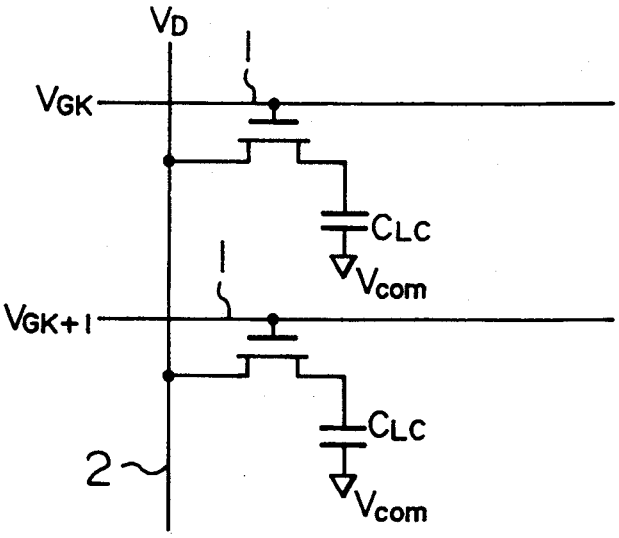
FIGS. 2A and 2B are diagrams showing a driving method according to a second embodiment of the present invention.
Figure 2B:
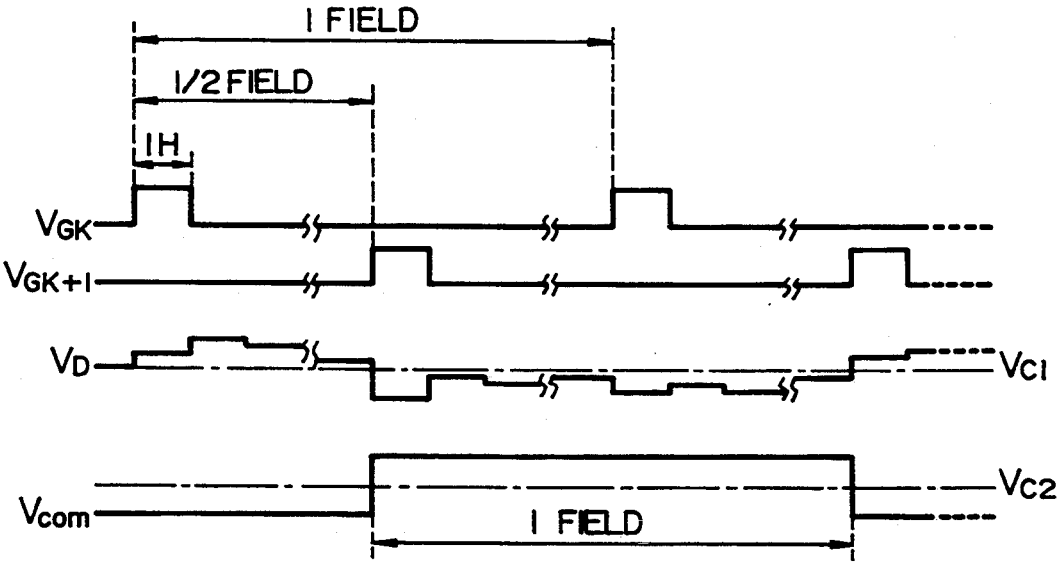

FIGS. 2A and 2B show a driving method according to a second embodiment of the present invention. The circuit arrangement of the display of the second embodiment is such that the scan electrode 1 is connected to a gate of each TFT, a signal electrode 2 is connected to a drain of each TFT, one liquid crystal terminal is connected to a source of each TFT, and the other liquid crystal terminal is connected to an opposite electrode. As shown, $V_{GK}$ and $V_{GK1}$ denote any gate voltage. $V_D$ denotes any drain voltage. $V_{com}$ denotes a voltage applied to the opposite electrode. $C_{LC}$ denotes a liquid crystal capacitance. $V_{C1}$ denotes a central voltage of an amplitude of $V_D$. $V_{C2}$ denotes a central voltage of an amplitude of $V_{com}$. 1H denotes a selecting time of one scan line.

In operation, during an interval of ½ field of a first field, positive-polarity signals are applied to the group of pixels connected to odd scan lines. Then, during the remaining ½ field, negative-polarity signals are applied to the group of pixels connected to the even scan lines. Later, this process is repeated. That is, the driving method of the present embodiment is arranged so that the positive-polarity signal and the negative-polarity signal are applied to the drain electrodes in a manner to shift these signals by ½ field within a one-field time interval. The use of the driving method makes it possible to invert $V_D$ and $V_{com}$ like alternate current at each field. Hence, as compared to the conventional system for inversing the polarity at each scan line, the driving method of this embodiment can reduce the driving current to a small value. This results in making it easier to design both of the voltage-alternating circuits for $V_D$ and $V_{com}$. Further, the current of the active matrix liquid crystal display can be reduced and the noise voltage can be suppressed accordingly, which can offer a high-definition display and improve the reliability of the active matrix liquid crystal display. In addition, the use of this driving method makes it possible to offset the flicker appearing by applying a d.c. voltage into a group of a liquid crystal pixels connected to the even scan lines against the flicker appearing by applying a d.c. voltage into a group of pixels connected to the odd scan lines. This results in reducing the flicker on the overall screen.

Figure 8:
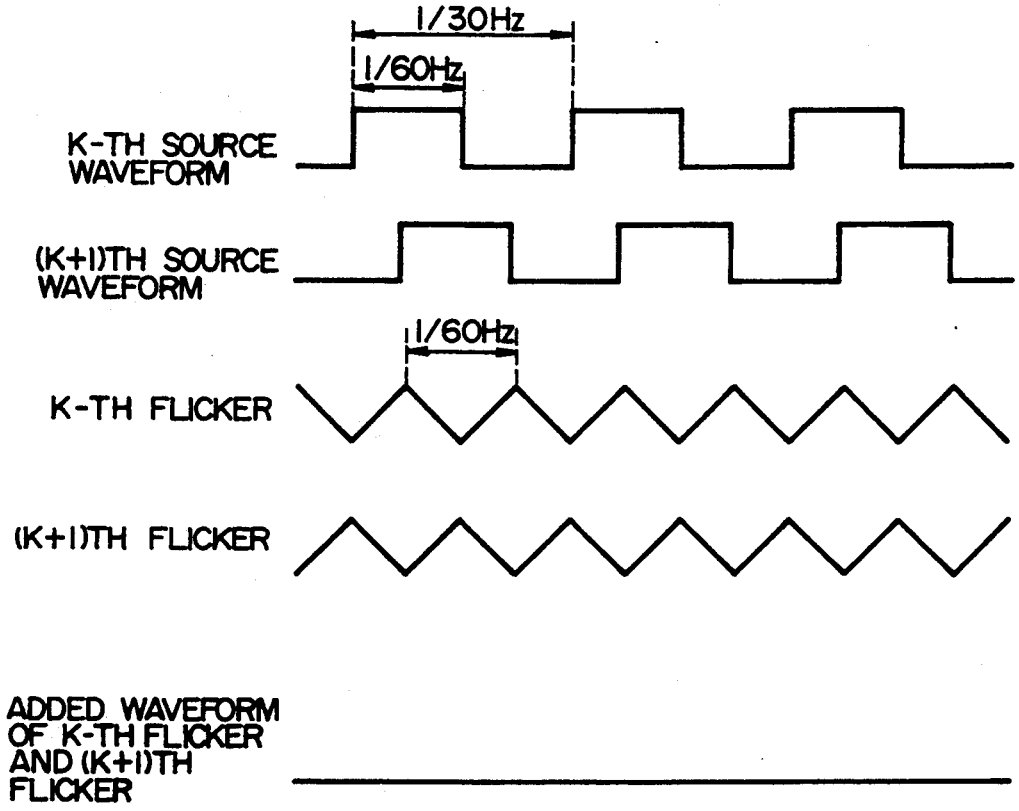
FIG. 8 is a timing chart showing a state where a flicker of 60 Hz is alleviated.
Figure 9:
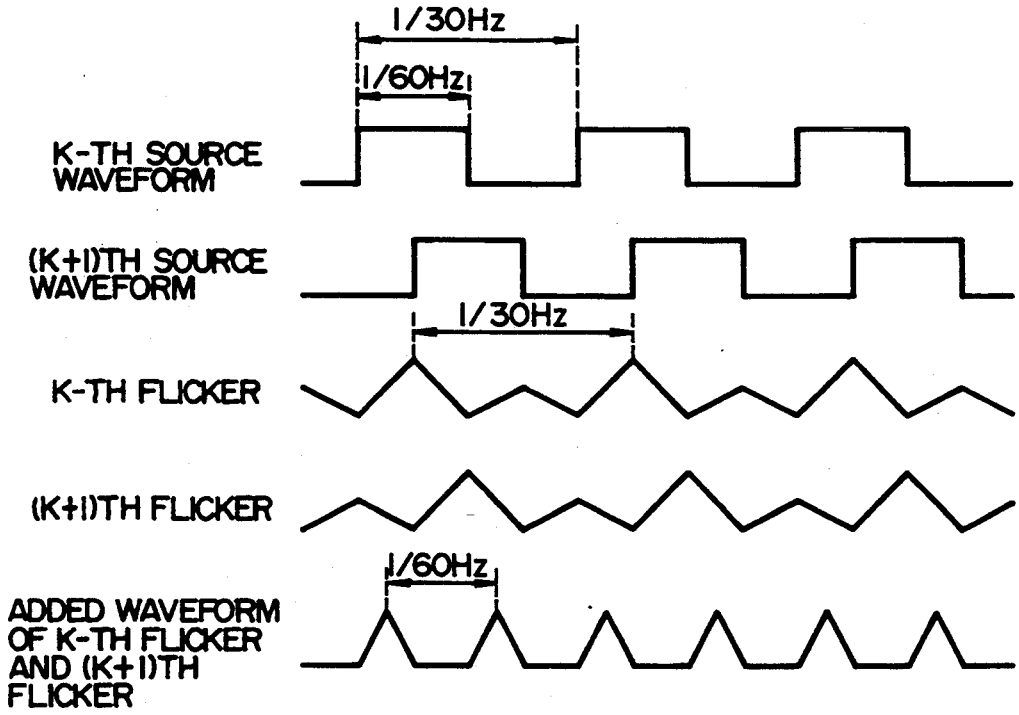
FIG. 9 is a timing chart showing a state where a flicker of 30 Hz is alleviated.
Figure 10A:
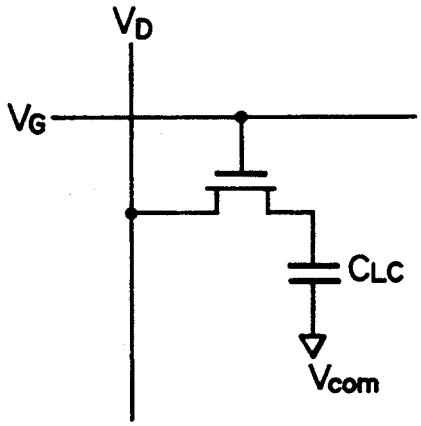
FIG. 10A PRIOR ART
FIGS. 10A and 10B are diagrams showing a conventional display driving method.
Figure 10B:
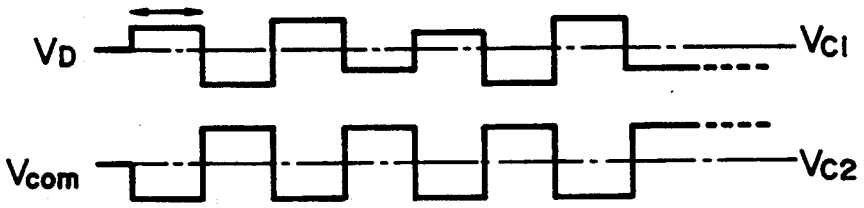
FIG. 10B PRIOR ART

FIGS. 8 and 9 show how the flicker is reduced on the overall screen if the driving method of this embodiment is used. In particular, FIG. 8 shows how the flicker of 60 Hz is alleviated and FIG. 9 shows how the flicker of 30 Hz is alleviated. According to the driving method of the second embodiment as shown in FIG. 8, if the flicker appearing to the pixels connected to the K-th scan line is added to the flicker appearing to the pixels connected to the (K+1)th scan line, the resulting flicker has a tabular waveform. This means that the flicker on the overall screen is made smaller. According to the driving method of the second embodiment as shown in FIG. 9, the actual flicker is an addition of the flicker appearing in the pixels connected to the k-th scan line to the flicker appearing in the pixels connected to (K+1)th scan line. This additive flicker has only the flicker of 60 Hz with no flicker of 30 Hz. A human cannot visually feel the flicker of 60 Hz. This means that the flicker on the overall screen is reduced.

Figure 3A:
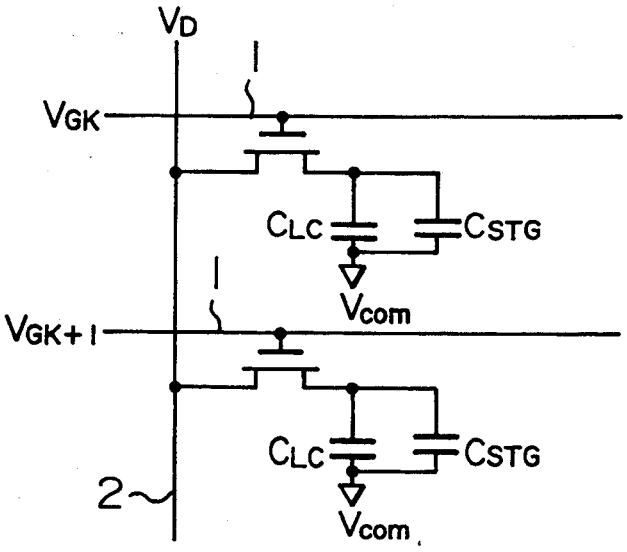
FIGS. 3A and 3B are diagrams showing a driving method according to a third embodiment of the present invention.
Figure 3B:
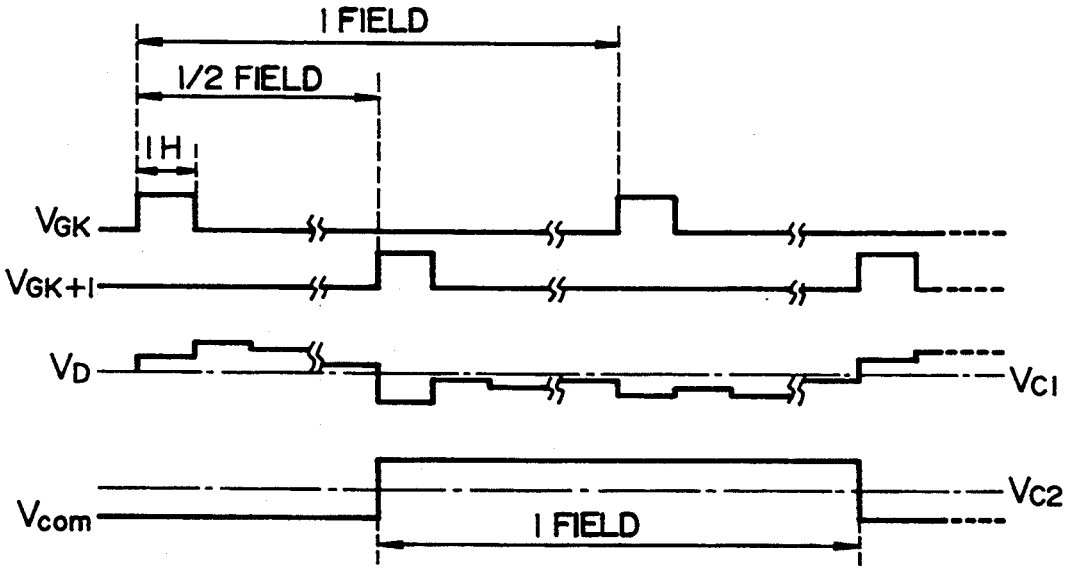

FIGS. 3A and 3B show a driving method according to a third embodiment of the present invention. In the circuit arrangement of a pixel of a display unit, as shown, a gate of a TFT is connected to a scan electrode 1 and a drain of the TFT is connected to a signal electrode 2. One liquid crystal terminal and a storage capacitance electrode are connected to a source of the TFT. The other liquid crystal terminal and storage capacitance electrode are connected to an opposite electrode. As shown, $V_{GK}$ and $V_{KG+1}$ denote any gate voltage. $V_D$ denotes any drain voltage. $V_{com}$ denotes a voltage applied to the opposite electrode. $C_{LC}$ denotes a liquid crystal capacitance. $C_{STG}$ denotes a storage capacitance. $V_{C1}$ denotes a central voltage of an amplitude of $V_D$. $V_{C2}$ denotes a central voltage of an amplitude of $V_{com}$. 1H denotes a selecting time of one scan line.

In operation, during a time interval of the first ½ field of one field, positive-polarity signals are applied to a group of pixels connected to odd scan lines. Then, during a time interval of the remaining ½ field, negative-polarity signals are applied to the group of pixels connected to even scan lines. During the first ½ field of the next field, the negative-polarity signals are applied to the group of pixels connected to the odd scan lines. Then, during the remaining ½ field, the positive-polarity signals are applied to the group of pixels connected to the even scan lines. Later, this process is repeated. That is, the driving method of the third embodiment is arranged so that the positive-polarity signals and the negative-polarity signals served as a display signal within one field are applied to a group of drain electrodes in a manner to shift both of the signals by ½ field. The use of the driving method makes it possible to invert $V_D$ and $V_{com}$ like alternate current at each field. Hence, this driving method makes it easier to design both of the voltage-alternating circuits for $V_D$ and $V_{com}$ and thereby improve the reliability of an active matrix liquid crystal display. In addition, the use of this driving method makes it possible to offset the flicker appearing in a group of a liquid crystal pixels connected to the even scan lines against the flicker appearing in a group of pixels connected to the odd scan lines. This results in reducing the flicker on the overall screen.

Figure 4A:
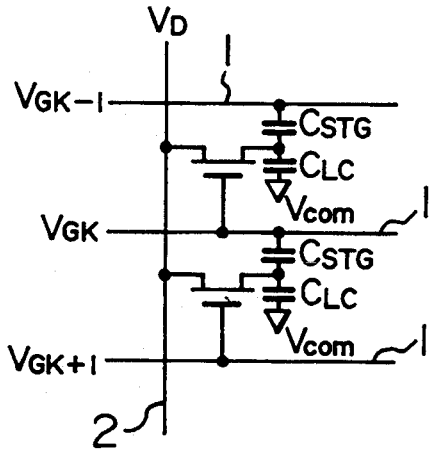
FIGS. 4A and 4B are diagrams showing a driving method according to a fourth embodiment of the present invention.
Figure 4B:
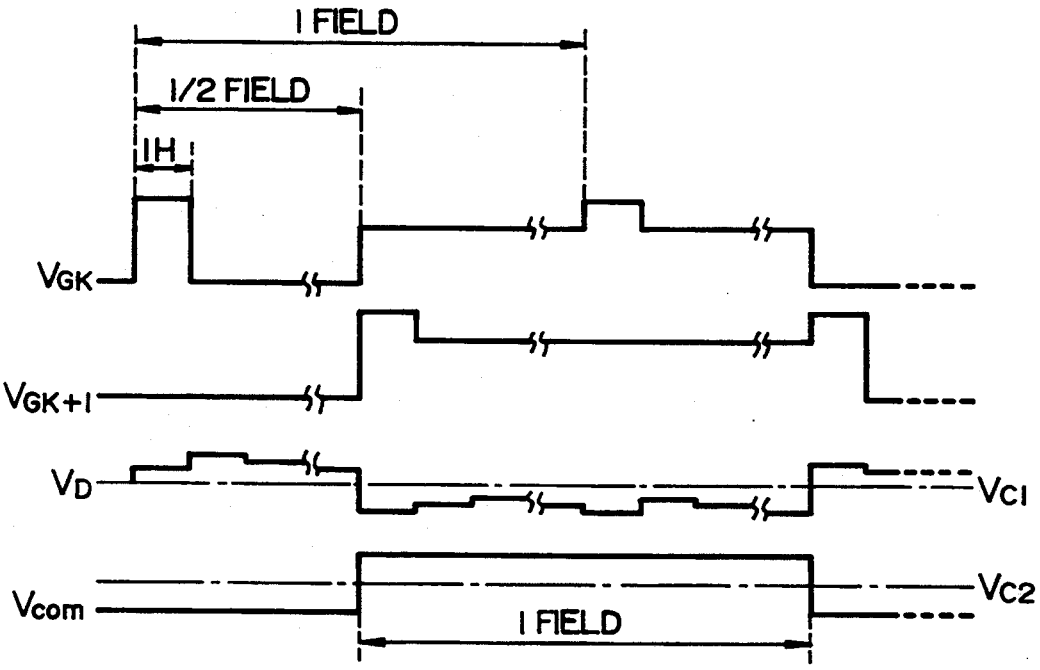

FIGS. 4A and 4B show a driving method according to a fourth embodiment of the present invention. In the circuit arrangement of a pixel of a display unit, as shown, a scan electrode 1 is connected to a gate of a TFT and a signal electrode 2 is connected to a drain of the TFT. One liquid crystal terminal is connected to a source of the TFT and the other liquid crystal terminal is connected to an opposite electrode. One storage capacitance electrode is connected to a source of the TFT and the other storage capacitance electrode is connected to a scan electrode at the previous stage.

As shown, $V_{GK-1}$ $V_{GK}$ and $V_{KG+1}$ denote any gate voltage. $V_D$ denotes any drain voltage. $V_{com}$ denotes a voltage applied to the opposite electrode. $C_{LC}$ denotes a liquid crystal capacitance. $C_{STG}$ denotes a storage capacitance. $V_{C1}$ denotes a central voltage of an amplitude of $V_D$. $V_{C2}$ denotes a central voltage of an amplitude of $V_{com}$. 1H denotes a selecting time of one scan line. The other storage capacitance electrode is connected to the scan electrode at the previous stage. As shown, the gate voltage needs to have three stages.

In operation, during a time interval of a first ½ field of one field, positive-polarity signals are applied to the group of pixels connected to odd scan lines. Then, during the remaining ½ field, negative-polarity signals are applied to the group of pixels connected to even scan lines. During a time interval of a first ½ field of the next field, negative-polarity signals are applied to the group of pixels connected to the odd scan lines. Then, during the remaining ½ field, positive-polarity signals are applied to the group of pixels connected to the even scan lines. Then, this process is repeated. That is, the positive-polarity signals and the negative-polarity signals are applied to a group of drain electrodes in such a manner that these signals are shifted by 1/n (n>1) field within one field. This driving method is, therefore, arranged so as to invert $V_D$ and $V_{com}$ like alternate current at each one field. This makes it possible to more easily design both of the voltage-alternating circuits for $V_D$ and $V_{com}$, thereby improving the reliability of an active matrix liquid crystal display to which the driving method applies. Moreover, in the driving method, it is more likely that the flicker appearing in the group of pixels connected to the even scan lines may be offset against the flicker appearing in the group of pixels connected to the odd scan lines. This results in reducing the flicker on the overall display.

In a case that an active matrix liquid crystal display uses amorphous silicon TFTs, since the amorphous silicon TFT has a low current feeding capability, in actuality, it is quite difficult to actuate a high-definition display consisting of 1024 scan lines to keep the display at high quality. In particular, when a gate pulse width is short, a positive-polarity drain signal may not be sufficiently applied to the liquid crystal display terminal through the amorphous silicon TFT (a-Si TFT). This is because the voltage $V_{GS}$ between the gate and the source when the TFT is active is made lower according to the rise of an electric potential at the liquid crystal terminal and the on-resistance of each TFT is made higher accordingly. On the other hand, when the drain signal is at negative polarity, $V_{GS}$ is kept constant without having any relation with lowering of an electric potential at the liquid crystal terminal. Hence, the on-resistance of each TFT is quite low. This means that when the drain signal is at negative polarity, the drain signal is allowed to be applied to the liquid crystal terminal at a relatively fast speed.

Next, the description will be directed to an embodiment which enables solving the foregoing problems.

Figure 5A:
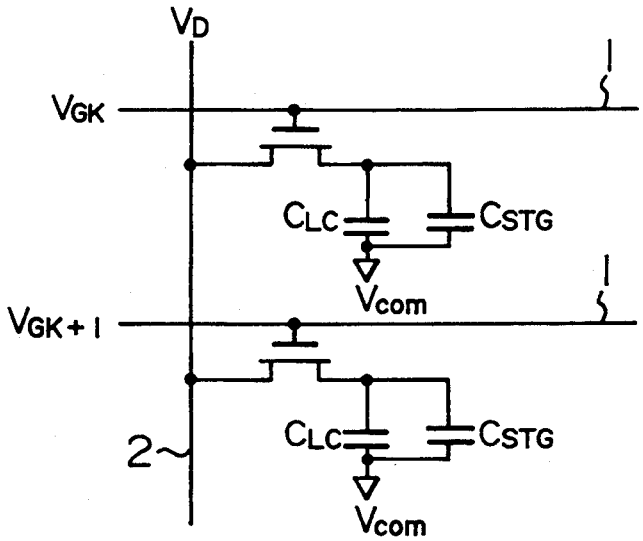
FIGS. 5A and 5B are diagrams showing a driving method according to a fifth embodiment of the present invention.
Figure 5B:
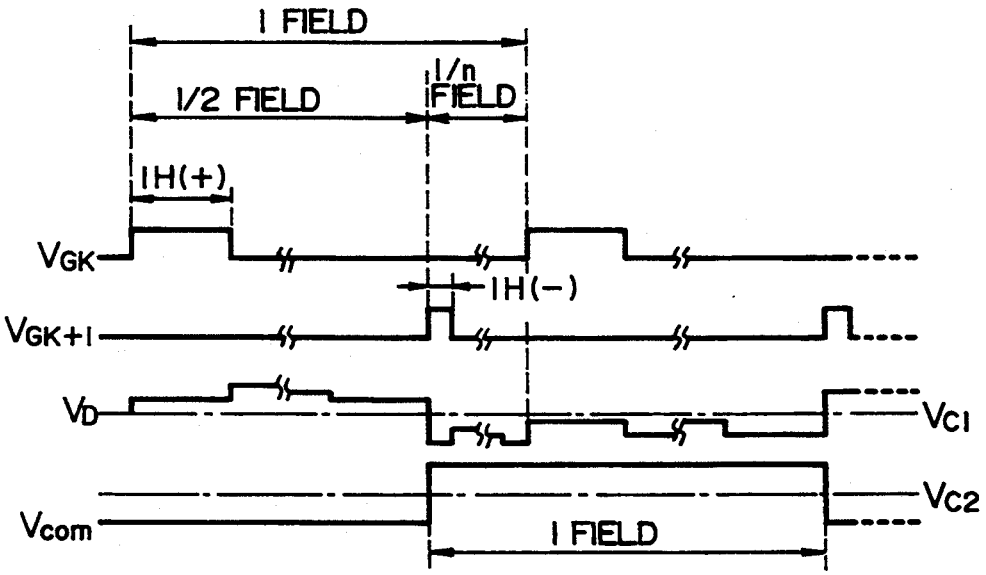

FIGS. 5A and 5B show a driving method according to a fifth embodiment of the present invention.

In the circuit arrangement of a pixel of a display unit, as shown, a scan electrode 1 is connected to a gate of a TFT and a signal electrode 2 is connected to a drain of the TFT. One liquid crystal terminal and storage capacitance electrode are connected to a source of the TFT and the other liquid crystal terminal and storage capacitance electrode are connected to an opposite electrode. As shown, $V_{GK}$ and $V_{GK+1}$ denote any gate voltage. $V_D$ denotes any drain voltage. $V_{com}$ denotes a voltage applied to the opposite electrode. $C_{LC}$ denotes a liquid crystal capacitance. $C_{STG}$ denotes a storage capacitance. $V_{C1}$ denotes a central voltage of an amplitude of $V_D$. $V_{C2}$ denotes a central voltage of an amplitude of $V_{com}$. 1H(+) denotes a gate pulse width provided when a positive-polarity signal is applied. 1H(−) denotes a gate pulse width provided when a negative-polarity signal is applied.

That is, the use of the driving method shown in FIGS. 5A and 5B make the gate pulse width at the positive-polarity drain signal longer than the gate pulse width at the negative-polarity drain signal. Hence, though the a-Si TFT has a low driving capability when a positive-polarity signal is applied, since the gate pulse width is longer, a sufficient drain signal is allowed to be applied to the liquid crystal terminal. The driving method of the fifth embodiment allows a high-definition display consisting of about 1024 scan lines to have an excellent display quality.

Figure 6A:
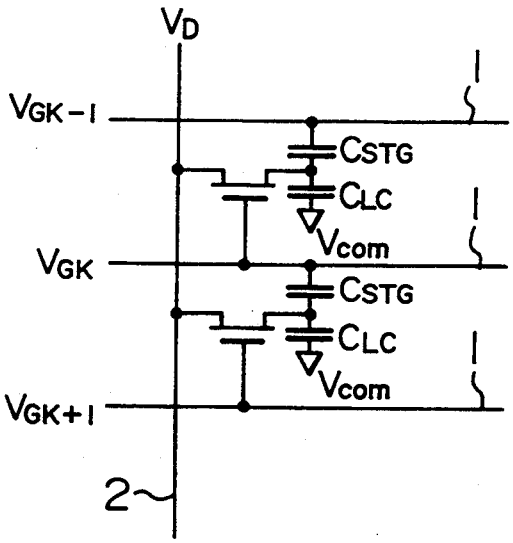
FIGS. 6A and 6B are diagrams showing a driving method according to a sixth embodiment of the present invention.
Figure 6B:
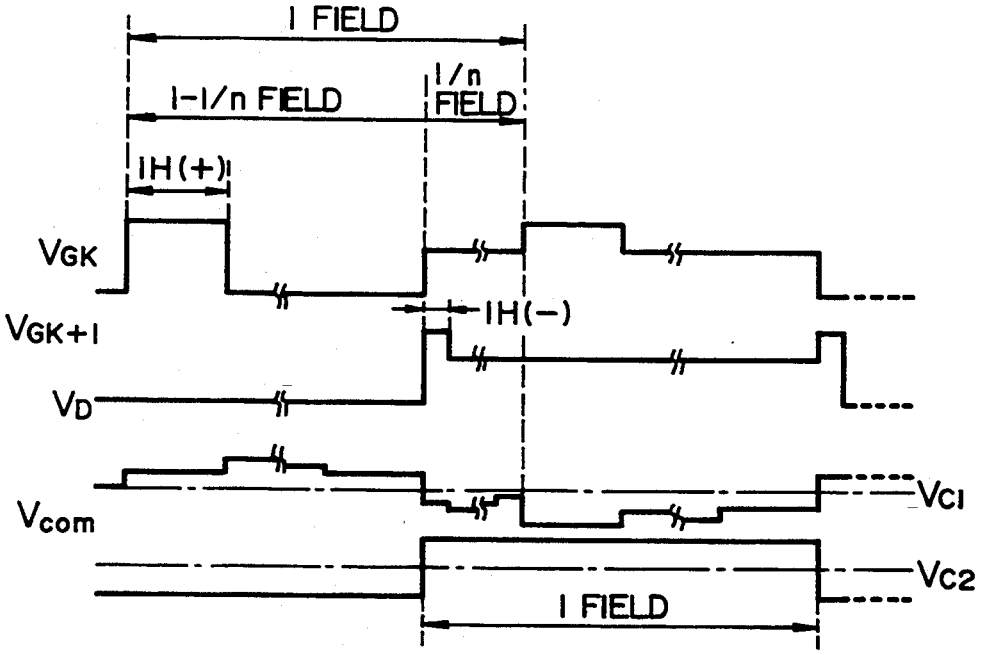

FIGS. 6A and 6B show a driving method according to a sixth embodiment of the present invention.

One of the pixels included in a display unit is arranged so that a scan electrode 1 is connected to a gate of a TFT and a signal electrode is connected to a drain of the TFT. One liquid crystal terminal is connected to a source of the TFT and the other liquid crystal terminal is connected to an opposite electrode. One storage capacitance electrode is connected to the source of the TFT and the other storage capacitance electrode is connected to a scan electrode at the previous stage.

As shown in FIG. 6, $V_{GK-1}$, $V_{GK}$ and $V_{GK+1}$ denote any gate signal. $V_D$ denotes any drain voltage. $V_{com}$ denotes a voltage applied to the opposite electrode. $C_{LC}$ denotes a liquid crystal capacitance. $C_{STG}$ denotes a storage capacitance. $V_{C1}$ denotes a central voltage of an amplitude of $V_D$. $V_{C2}$ denotes a central voltage of an amplitude of Vcom. 1H(+) denotes a gate pulse width provided when a positive-polarity signal is applied. 1H(−) denotes a gate pulse width provided when a negative-polarity signal is applied. That is, the driving method of this embodiment makes the gate pulse width given when the drain signal is at positive polarity longer than that given when the drain signal is at negative polarity. Hence, the a-Si TFT has a low driving capability when it is at positive polarity. Since, however, the gate pulse width is longer, the drain signal is sufficiently applied to the liquid crystal terminal. The driving method of this embodiment allows a high-definition display consisting of about 1024 lines to have an excellent display quality.

Figure 7:
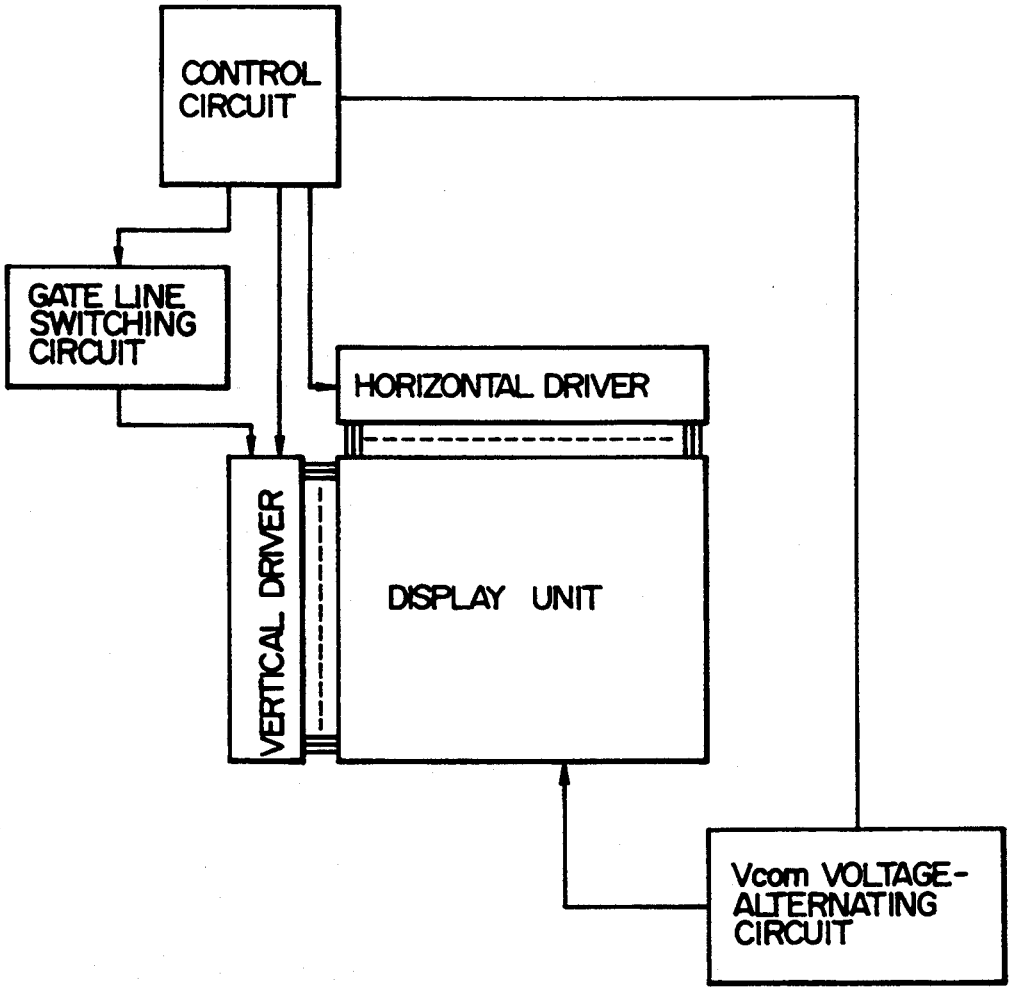
FIG. 7 is a diagram showing a liquid crystal display to which the driving method of this invention may apply.

FIG. 7 shows a thin film transistor liquid crystal display (referred to as a TFT-LCD). In order to apply the driving method of this invention to the TFT-LCD, it is necessary to add a gate line switching circuit for separating the scan lines into odd lines and even lines at one field and a $V_{com}$ voltage-alternating circuit for changing a polarity of a $V_{com}$ voltage at each one field as shown in FIG. 7. This arrangement needs $V_D$ to be alternated just at each field. Hence, it improves the reliability of the TFT-LCD.

What is claimed is:

1. A method of driving a liquid crystal display unit in a frame format wherein each frame is comprised of two contiguous fields, wherein the liquid crystal display unit is arranged to have thin film transistors provided in a manner to correspond to pixels, each including a liquid crystal, located on a substrate in a matrix form, said thin film transistors serving to switch voltages to the corresponding pixels, a plurality of scan electrodes each commonly connected to gates of said thin film transistors of each row, a plurality of signal electrodes each commonly connected to drains of said thin film transistors of each column, first liquid crystal terminal electrodes each connected to a source of a respective one of said thin film transistors, and a second liquid crystal terminal coupled to a voltage source to drive said liquid crystal, wherein said liquid crystal is interposed between said first and second liquid crystal terminals, said method comprising the steps of:

applying signals which each have a first polarity to a plurality of odd-numbered signal electrodes in a first interval in a first field of a frame;

applying signals each having a second polarity opposite to said first polarity to a plurality of even-numbered signal electrodes in a second interval in said first field of said frame, applying signals each having said second polarity to said plurality of odd-numbered signal electrodes in a first interval in a second field of said frame, said second field being contiguous to said first field, applying signals each having said first polarity to said plurality of even-numbered signal electrodes in a second interval in said second field in said frame.

2. A method as claimed in claim 1, wherein a voltage which changes in each field is applied to said second liquid crystal terminal electrodes.

3. A method as claimed in claim 1, wherein said first and second intervals of each field are each ½ field.

4. A method as claimed in claim 1, wherein one of said first and second polarities is a positive polarity and the other of said first and second polarities is a negative polarity, wherein a gate pulse width of a pulse signal applied to said gates when positive polarity signals are applied to said plurality of signal electrodes is longer than that applied when negative polarity signals are applied to said plurality of signal electrodes.

5. A method of driving a liquid crystal display unit in a frame format wherein each frame is comprised of two contiguous fields, wherein the liquid crystal display unit is arranged to have thin film transistors provided in a manner to correspond to pixels each including a liquid crystal and a storage capacitance located on a substrate in a matrix form, said thin film transistors serving to switch voltages to the corresponding pixels, a plurality of scan electrodes each commonly connected to gates of said thin film transistors of each row, a plurality of signal electrodes each commonly connected to drains of said thin film transistors of each column, first liquid crystal terminal electrodes and first storage capacitance terminal electrodes each connected to a source of a respective one of said thin film transistors, and second liquid crystal terminal electrodes coupled to a voltage source to drive said liquid crystal, wherein said liquid crystal is interposed between said first and second liquid crystal terminals, said method comprising the steps of:

applying positive-polarity signals to a plurality of odd-numbered signal electrodes during a first interval in a first field of a frame;

applying negative-polarity signals to a plurality of even-numbered signal electrodes during a second interval in said first field of said frame, applying negative polarity signals to said plurality of odd-numbered signal electrodes during a first interval in a second field of said frame, said second field being contiguous to said first field; and applying positive polarity signals to said plurality of even-numbered signal electrodes during a second interval in said second field of said frame.

6. A method as claimed in claim 5, wherein a voltage which changes in each field is applied to said second liquid crystal terminal electrodes.

7. A method as claimed in claim 5, wherein said first and second intervals of each field are each ½ field.

8. A method as claimed in claim 5, wherein second storage capacitance terminal electrodes are coupled to said voltage source.

9. A method as claimed in claim 5, wherein second storage capacitance terminal electrodes are coupled to said scan electrodes.

10. A method as claimed in claim 5, wherein a gate pulse width of a pulse signal applied to said gates when said positive-polarity signals are applied to said plurality of signal electrodes is longer than that applied when said negative-polarity signals are applied to said plurality of signal electrodes.

11. An apparatus comprising:

liquid crystal display unit including:

thin film transistors provided in a manner to correspond to pixels, each including a liquid crystal, located on a substrate in a matrix form, said thin film transistors serving to switch voltages to the corresponding pixels, a plurality of scan electrodes each commonly connected to gates of said thin film transistors of each row, a plurality of signal electrodes each commonly connected to drains of said thin film transistors of each column, first liquid crystal terminal electrodes each connected to a source of a respective one of said thin film transistors, and a second liquid crystal terminal coupled to a voltage source to drive said liquid crystal, wherein said liquid crystal is interposed between said first and second liquid crystal terminals, and means for driving the liquid crystal display unit in a frame format, wherein each frame is comprised of two contiguous fields, including:

means for applying signals which each have a first polarity to a plurality of odd-numbered signal electrodes in a first interval in a first field of a frame;

means for applying signals each having a second polarity opposite to said first polarity to a plurality of even-numbered signal electrodes in a second interval in said first field of said frame;

means for applying signals each having said second polarity to said plurality of odd-numbered signal electrodes in a first interval in a second field of said frame, said second field being contiguous to said first field; and means for applying signals each having said first polarity to said plurality of even-numbered signal electrodes in a second interval in said second field in said frame.

12. An apparatus according to claim 11, further comprising means for applying a voltage which changes in each field to said second liquid crystal terminal electrodes.

13. An apparatus as claimed in claim 11, wherein said first and second intervals of each field are each ½ field.

14. An apparatus as claimed in claim 11, wherein one of said first and second polarities is a positive polarity and the other of said first and second polarities is a negative polarity, wherein a gate pulse width of a pulse signal applied to said gates when positive polarity signals are applied to said plurality of signal electrodes is longer than that applied when negative polarity signals are applied to said plurality of signal electrodes.

15. An apparatus comprising:

a liquid crystal display unit including:

thin film transistors provided in a manner to correspond to pixels each including a liquid crystal and a storage capacitance located on a substrate in a matrix form, said thin film transistors serving to switch voltages to the corresponding pixels, a plurality of scan electrodes each commonly connected to gates of said thin film transistors of each row, a plurality of signal electrodes each commonly connected to drains of said thin film transistors of each column, first liquid crystal terminal electrodes and first storage capacitance terminal electrodes each connected to a source of a respective one of said thin film transistors, and second liquid crystal terminal electrodes coupled to a voltage source to drive said liquid crystal, wherein said liquid crystal is interposed between said first and second liquid crystal terminals; and means for driving the liquid crystal display unit in a frame format, wherein each frame is comprised of two contiguous fields, including:

means for applying positive-polarity signals to a plurality of odd-numbered signal electrodes during a first interval in a first field of a frame;

means for applying negative-polarity signals to a plurality of even-numbered signal electrodes during a second interval in said first field of same frame;

means for applying negative polarity signals to said plurality of odd-numbered signal electrodes during a first interval in a second field of said frame, said second field being contiguous to said first field; and means for applying positive polarity signals to said plurality of even-numbered signal electrodes during a second interval in said second field of said frame.

16. An apparatus according to claim 15, further comprising means for applying a voltage which changes in each field to said second liquid crystal terminal electrodes.

17. An apparatus as claimed in claim 15, wherein said first and second intervals of each field are each ½ field.

18. A method as claimed in claim 15, wherein a gate pulse width of a pulse signal applied to said gates when said positive-polarity signals are applied to said plurality of signal electrodes is longer than that applied when said negative-polarity signals are applied to said plurality of signal electrodes.

* * * * *